US010453399B2

(12) United States Patent
Yu

(10) Patent No.: US 10,453,399 B2
(45) Date of Patent: Oct. 22, 2019

(54) GRAYSCALE VOLTAGE ADJUSTING APPARATUS AND METHOD, DISPLAY DRIVING APPARATUS AND DISPLAY APPARATUS

(71) Applicant: BOE TECHNOLOGY GROUP CO., LTD., Beijing (CN)

(72) Inventor: Yong Yu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/992,917

(22) Filed: May 30, 2018

(65) Prior Publication Data

US 2019/0043429 A1 Feb. 7, 2019

(30) Foreign Application Priority Data

Aug. 1, 2017 (CN) ..... 2017 1 0647961

(51) Int. Cl.

*G09G 5/10* (2006.01)
*G09G 3/3291* (2016.01)
*G09G 3/20* (2006.01)

(52) U.S. Cl.

CPC ..... *G09G 3/3291* (2013.01); *G09G 3/2092* (2013.01); *G09G 2310/027* (2013.01);
(Continued)

(58) Field of Classification Search

CPC .. G09G 3/3291; G09G 3/2092; G09G 3/3648; G09G 3/2011; G09G 3/3688;
(Continued)

(56) References Cited

U.S. PATENT DOCUMENTS 9,734,781 B2 * 8/2017 Syu ..... G09G 3/3648
9,972,259 B2 * 5/2018 Ouyang ..... G09G 3/3614
(Continued)

FOREIGN PATENT DOCUMENTS

CN 104809974 A 7/2015
CN 105702215 A 6/2016
(Continued)

OTHER PUBLICATIONS

First Office Action for Chinese Patent Application No. 201710647961.5 dated Nov. 8, 2018.

*Primary Examiner* — Vijay Shankar
(74) *Attorney, Agent, or Firm* — Calfee, Halter & Griswold LLP

(57) ABSTRACT

A grayscale voltage adjusting method includes: receiving luminance values of grayscales corresponding to three primary colors under at least one binding point, and receiving grayscale voltages corresponding to the three primary colors under the corresponding binding point; fitting the luminance values of grayscales corresponding to three primary colors under the plurality of binding points and the grayscale voltages corresponding to the three primary colors under the corresponding binding point, to obtain a luminance-grayscale voltage fitting result; and based on the luminance-grayscale voltage fitting result, according to a target luminance $L_g$ of each grayscale corresponding to three primary colors in a target image, acquiring a target grayscale voltage corresponding to the target luminance of each grayscale corresponding to three primary colors in the target image from the luminance-grayscale voltage fitting result, such that a display apparatus displays the target image according to the target grayscale voltage.

17 Claims, 3 Drawing Sheets

(52) U.S. Cl.
CPC ..... *G09G 2320/0233* (2013.01); *G09G 2320/0242* (2013.01); *G09G 2320/0276* (2013.01); *G09G 2320/0693* (2013.01); *G09G 2360/145* (2013.01)

(58) Field of Classification Search
CPC ..... G09G 3/3611; G09G 2320/0276; G09G 2310/027; G09G 2360/145; G09G 2320/0233; G09G 2320/0242; G09G 2320/0693
See application file for complete search history.

(56) References Cited

U.S. PATENT DOCUMENTS

| | | | | |
|---|---|---|---|---|
| 10,121,444 | B2 * | 11/2018 | Choi | G09G 3/3611 |
| 2018/0176527 | A1 * | 6/2018 | Li | H04M 1/22 |

FOREIGN PATENT DOCUMENTS

| | | | |
|---|---|---|---|
| CN | 106531050 | A | 3/2017 |
| CN | 106782303 | A | 5/2017 |

* cited by examiner

GRAYSCALE VOLTAGE ADJUSTING APPARATUS AND METHOD, DISPLAY DRIVING APPARATUS AND DISPLAY APPARATUS

TECHNICAL FIELD

The present disclosure relates to the field of display technology, and in particular, to a grayscale voltage adjusting apparatus and method, a display driving apparatus, and a display apparatus.

BACKGROUND

An organic electroluminescent display apparatus is a self-luminous display apparatus that does not require backlight, and light is emitted by each organic electroluminescent device. Since the organic electroluminescent display apparatus does not need a backlight source to provide backlight, the organic electroluminescent display apparatus is relatively thinner compared with a conventional liquid crystal display apparatus, which is beneficial to slimness development of the display apparatus, which also makes the organic electroluminescent display apparatus popular among users.

In order to improve the display image quality of the organic electroluminescent display apparatus, before distributing, a grayscale voltage of the organic electroluminescent display apparatus is generally adjusted, and the adjusted grayscale voltage is stored in a register. In this way, when the organic electroluminescent display apparatus is used, the organic electroluminescent display apparatus performs image display according to the grayscale voltage, so that the display image quality of the organic electroluminescent display apparatus meets requirements.

SUMMARY

The present disclosure provides the following technical solutions.

A grayscale voltage adjusting method, including:

step S100: receiving luminance values of grayscales corresponding to three primary colors under at least one binding point, and receiving grayscale voltages corresponding to the three primary colors under the corresponding binding point;

step S200: fitting the luminance values of grayscales corresponding to three primary colors under the plurality of binding points and the grayscale voltages corresponding to the three primary colors under the corresponding binding point, to obtain a luminance-grayscale voltage fitting result;

step S300: based on the luminance-grayscale voltage fitting result, according to a target luminance $L_g$ of each grayscale corresponding to three primary colors in a target image, acquiring a target grayscale voltage corresponding to the target luminance of each grayscale corresponding to three primary colors in the target image from the luminance-grayscale voltage fitting result, such that a display apparatus displays the target image according to the target grayscale voltage.

The present disclosure further provides a grayscale voltage adjusting apparatus, including:

a data receiving unit, configured to receive luminance values of grayscales corresponding to three primary colors under at least one binding point, and receive grayscale voltages corresponding to the three primary colors under the corresponding binding point;

a data fitting unit, connected to the data receiving unit and configured to fit the luminance values of grayscales corresponding to three primary colors under the plurality of binding points and the grayscale voltages corresponding to the three primary colors under the corresponding binding point, to obtain a luminance-grayscale voltage fitting result;

a data query unit, connected to the data fitting unit and configured to, based on the luminance-grayscale voltage fitting result, according to a target luminance $L_g$ of each grayscale corresponding to three primary colors in a target image, search a target grayscale voltage corresponding to the target luminance of each grayscale corresponding to three primary colors in the target image from the luminance-grayscale voltage fitting result, such that a display apparatus displays the target image according to the target grayscale voltage.

The present disclosure further provides a display driving apparatus, which includes the grayscale voltage adjusting apparatus provided by the above technical solution.

The present disclosure further provides a display apparatus, including the display driving apparatus provided by the above technical solution.

BRIEF DESCRIPTION OF THE DRAWINGS

The drawings are intended to provide a further understanding of the present disclosure and constitute a part of the present disclosure. The exemplary embodiments of the present disclosure and the description thereof are used to explain the present disclosure and do not constitute inappropriate limitations to the present disclosure. In the drawing.

DETAILED DESCRIPTION

The following will clearly and completely describe the technical solutions in the embodiments of the present disclosure with reference to the accompanying drawings in the embodiments of the present disclosure. Apparently, the described embodiments are merely a part of the embodiments of the present disclosure and not all of the embodiments. All other embodiments obtained by a person of ordinary skill in the art based on the embodiments of the present disclosure without creative efforts shall fall within the protection scope of the present disclosure.

Figure 1:
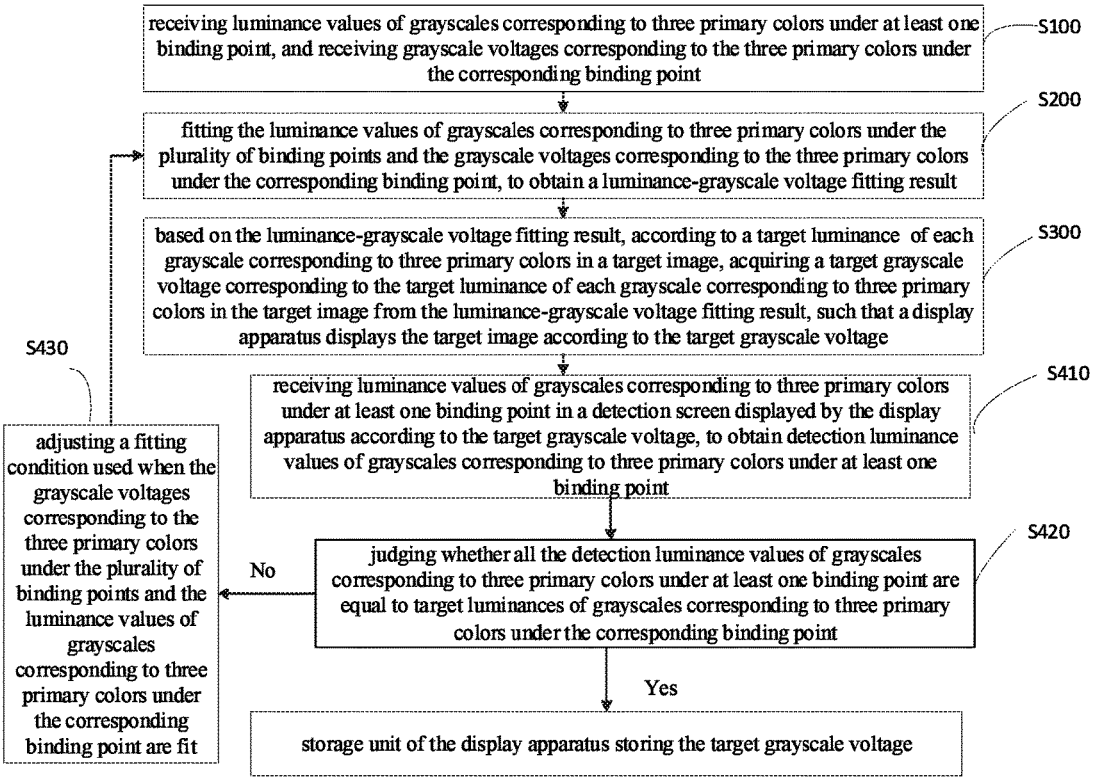
FIG. 1 is a flowchart of a grayscale voltage adjusting method according to an embodiment of the present disclosure.
Figure 4:
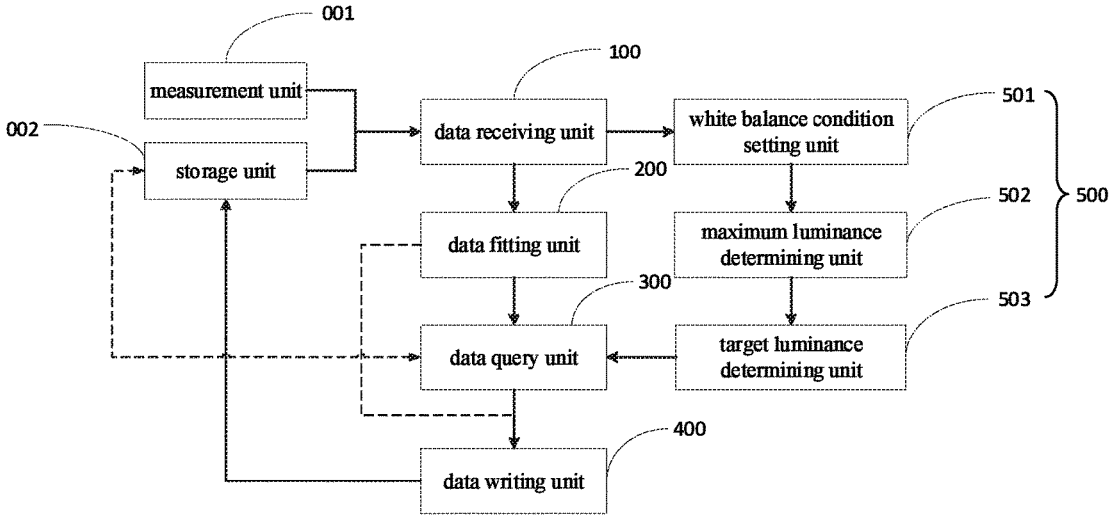
FIG. 4 is a structural block diagram of a grayscale voltage adjusting apparatus provided by an embodiment of the present disclosure.

Referring to FIGS. 1 and 4, a grayscale voltage adjusting method according to an embodiment of the present disclosure is provided, including following steps.

Step S100: luminance values of grayscales corresponding to three primary colors under at least one binding point are received, and grayscale voltages corresponding to the three primary colors under the corresponding binding point are received; the three primary colors include three colors of red, green, and blue.

Specifically, the luminance values of grayscales corresponding to three primary colors may be luminance values of a plurality of different binding points, or luminance values of the same binding point.

If the luminance values of grayscales corresponding to three primary colors under a plurality of binding points are received, the received grayscale voltages corresponding to the three primary colors under the corresponding binding point should also be grayscale voltages corresponding to the three primary colors under a plurality of binding points, and the luminance values of grayscales corresponding to three primary colors under the plurality of binding points are in one-to-one correspondence with the grayscale voltages corresponding to the three primary colors under the plurality of binding points.

Specifically, when the luminance values of grayscales corresponding to three primary colors under the plurality of binding points refer to luminance values of grayscales corresponding to three primary colors under a plurality of the same binding points, during specific operations, different grayscale voltages are randomly written into the storage unit 002 shown in FIG. 4 for several times. After each time the grayscale voltage is written into, the luminance values of grayscales corresponding to three primary colors under this binding points are measured by using the measurement unit 001 shown in FIG. 4, so that the luminance values of grayscales corresponding to three primary colors under the plurality of the same binding points and the grayscale voltages corresponding to the three primary colors under the same binding points may be obtained. When the luminance values of grayscales corresponding to three primary colors under the plurality of binding points refer to luminance values of grayscales corresponding to three primary colors under a plurality of different binding points, during specific operations, grayscale voltages are randomly written into the storage unit 002 (such as a register) shown in FIG. 4 under the plurality of binding points, such that the display apparatus displays a picture based on the grayscale voltages written randomly. The luminance values of grayscales corresponding to three primary colors under a plurality of binding points in the displayed picture are measured by using the measurement unit 001 shown in FIG. 4, so that the grayscale voltages corresponding to the three primary colors under the plurality of different binding points and the luminance values of grayscales corresponding to three primary colors under the plurality of different binding points may be obtained.

Exemplarily, the measurement unit 001 is generally an optical measuring device capable of monitoring the luminance of an image, such as a CA-310 color analyzer, a K8 color analyzer, or the like. Considering that the visual experience is different when viewing the picture displayed by the display apparatus at different angles and currently the user is generally located at a position directly facing the display apparatus when viewing the display picture, the measurement unit selects a screen geometric center of the display apparatus as much as possible when measuring the luminance values of a plurality of binding points. In this way, the user can get best visual experience when viewing the images displayed under the adjusted grayscale voltages.

In the above, the so-called three primary colors refer to colors in the three-primary-color space based on the RGB color model on the basis of the RBG in a general sense. Derived colors, such as white or other colors, generated based on the three-primary-color space may be converted by the RGB.

Step S200: the luminance values of grayscales corresponding to three primary colors under the plurality of binding points and the grayscale voltages corresponding to the three primary colors under the corresponding binding point are fit, to obtain a luminance-grayscale voltage fitting result.

Step S300: based on the luminance-grayscale voltage fitting result, according to a target luminance $L_g$ of each grayscale corresponding to three primary colors in a target image, a target grayscale voltage corresponding to the target luminance of each grayscale corresponding to three primary colors in the target image is searched from the luminance-grayscale voltage fitting result, such that a display apparatus displays the target image according to the target grayscale voltage.

As can be seen from the above grayscale voltage adjusting method, in the grayscale voltage adjusting method provided by embodiment of the present disclosure, the fitting is performed based on the luminance values of grayscales corresponding to three primary colors of a plurality of binding points and the grayscale voltages corresponding to the three primary colors under the corresponding binding point. The obtained luminance-grayscale voltage fitting result substantially includes the correspondence between the luminance and the grayscale voltage. In this way, when a picture having the target image quality needs to be obtained, regardless of the number of binding points, a target grayscale voltage corresponding to the target luminance of each grayscale corresponding to three primary colors in the target image may always be searched from the luminance-grayscale voltage fitting result, so that the display apparatus can display a picture having the target image quality according to the grayscale voltages stored by the storage unit. It can be seen that the grayscale voltage adjusting method provided by the present disclosure reduces the workload when adjusting the gray-scale voltage, so that the process of adjusting the gray-scale voltage is simplified, which greatly improves the adjustment efficiency.

Specifically, the foregoing step S300 may specifically adopt the following two specific implementation manners, which are described in detail below.

A first specific implementation manner is: writing the luminance-grayscale voltage fitting result into a first storage unit of the display apparatus, querying the target grayscale voltage corresponding to the target luminance of each grayscale corresponding to three primary colors in the target image from the luminance-grayscale voltage fitting result stored in the first storage unit according to the target luminance $L_g$ of each grayscale corresponding to three primary colors in the target image, and storing the same in a second storage unit of the display apparatus, such that the display apparatus displays the target image according to the target grayscale voltage stored in the second storage unit.

In the embodiment, storing the target grayscale voltage corresponding to the target luminance of each grayscale corresponding to three primary colors in the target image in the second storage unit is essentially a process of writing the target grayscale voltage corresponding to the target luminance of each grayscale corresponding to three primary colors in the target image into the second storage unit.

A second specific implementation manner is: based on the target luminance $L_g$ of each grayscale corresponding to three primary colors in the target image, searching a grayscale voltage corresponding to the target luminance of each grayscale corresponding to three primary colors in the target image from the luminance-grayscale voltage fitting result; writing the grayscale voltage corresponding to the target luminance of each grayscale corresponding to three primary colors in the target image into a second storage unit of the display apparatus, such that the display apparatus displays the target image according to the target grayscale voltage stored in the second storage unit.

Since the grayscale voltages corresponding to the target luminances of each grayscale corresponding to three primary colors in the target image have been determined, the grayscale voltages corresponding to the target luminances of each grayscale corresponding to three primary colors in the target image are written into the second storage unit at one time, so as to update the grayscale voltages originally stored in the second storage unit, so that the display apparatus displays a picture having a target image quality according to the target grayscale voltage.

In the above two manners, it is easy to understand that the first manner requires more storage space to store and maintain the corresponding luminance-grayscale voltage data table of the luminance-grayscale voltage fitting result, but facilitates the later query speed of the target grayscale voltage corresponding to the target luminance of each grayscale corresponding to three primary colors in the target image; the second manner only needs to set a logical operation processor to perform the luminance-grayscale voltage fitting process, without storing the fit luminance-grayscale voltage data table, but the processing capability of the logic operation processor is consumed during the later query.

For the logic operation processor in the circuit, the first storage unit and/or the second storage unit in the above manners are the same and constitute a memory structure outside the processor. Therefore, for the convenience of drawing, they are designated as the storage unit 002 uniformly (at this time, it can be considered that the storage unit includes the first storage unit and/or the second storage unit) in the drawings. Meanwhile, as for the first manner, the first storage unit and the second storage unit may be implemented by different physical storage hardware, or may be implemented by using one physical storage hardware, such as a register, a memory, and the like on the display.

When the display apparatus displays a picture having a target image quality according to the target grayscale voltage, the stored target grayscale voltage is first taken out from the second storage unit and written into a corresponding driving chip, so that the display panel in the display apparatus displays the picture having a target image quality based on the grayscale voltage stored in the driving chip, i.e., to make the display panel in the display apparatus indirectly displays the picture having a target image quality based on the grayscale voltage stored in the second storage unit.

The received luminance values of the grayscales corresponding to the three primary colors under the at least one binding point and the received gray voltages corresponding to the three primary colors under the corresponding binding point may generally be classified into three groups of data according to different colors. Each group of data represents luminance values of the grayscale corresponding to one color under the binding point of the same color, and the grayscale voltage corresponding to the color under the corresponding binding point.

When there is no data fitting, if the correspondence between the luminance values of the grayscale corresponding to the three primary colors and the grayscale voltages corresponding to the three primary colors is to be obtained, the number of luminance values of the grayscale corresponding to the three primary colors under the received binding point and grayscale voltages corresponding to the three primary colors under this binding point should be multiple. The multiple herein can refer to: luminance values of grayscales corresponding to three primary colors under a plurality of the same binding points and grayscale voltages corresponding to the three primary colors under the corresponding binding point; it may also refer to: luminance values of grayscales corresponding to three primary colors under a plurality of different binding points and grayscale voltages corresponding to the three primary colors under the corresponding binding point. In order to improve the accuracy, it is preferable to use the luminance values of the grayscale corresponding to the three primary colors under a plurality of different binding points and the grayscale voltages corresponding to the three primary colors under the corresponding binding point.

After the luminance values of grayscales corresponding to three primary colors under a plurality of binding points and the grayscale voltages corresponding to the three primary colors under the corresponding binding point are received, three correlation curves of the luminance values and grayscale voltages are plotted according to different colors of the primary colors.

For example, when the three primary colors are red, green and blue, a correlation curve of the luminance values of the grayscale corresponding to the red color under a plurality of binding points and the grayscale voltages corresponding to the red color is drawn, a correlation curve of the luminance values of the grayscale corresponding to the green color under a plurality of binding points and the grayscale voltages corresponding to the green color is drawn, and a correlation curve of the luminance values of the grayscale corresponding to the blue color under a plurality of binding points and the grayscale voltages corresponding to the blue color is drawn.

However, the above curve is drawn based on the points determined by the luminance values of the grayscale corresponding to the three primary colors under a plurality of binding points and the grayscale voltages corresponding to the three primary colors under a plurality of binding points. Therefore, a certain degree of error exists in the drawn curve, which makes a serious deviation generated when adjusting the grayscale voltage. In view of this, the luminance values of grayscales corresponding to three primary colors under a plurality of binding points and the grayscale voltages corresponding to the three primary colors under the corresponding binding point are fit, so that the luminance-grayscale voltage fitting result can reasonably reflect the relationship of the luminance values of grayscales corresponding to three primary colors under different binding points and the grayscale voltages corresponding to the three primary colors under different binding points.

In the first method, the fitting the luminance values of grayscales corresponding to three primary colors under the plurality of binding points and the grayscale voltages corresponding to the three primary colors under the corresponding binding point, to obtain a luminance-grayscale voltage fitting result includes:

fitting the luminance values of grayscales corresponding to three primary colors under the plurality of binding points and the grayscale voltages corresponding to the three primary colors under the corresponding binding point by using a Lagrange interpolation method, to obtain the luminance-grayscale voltage fitting result; the luminance-grayscale voltage fitting result being a Lagrange interpolation polynomial.

Figure 2:
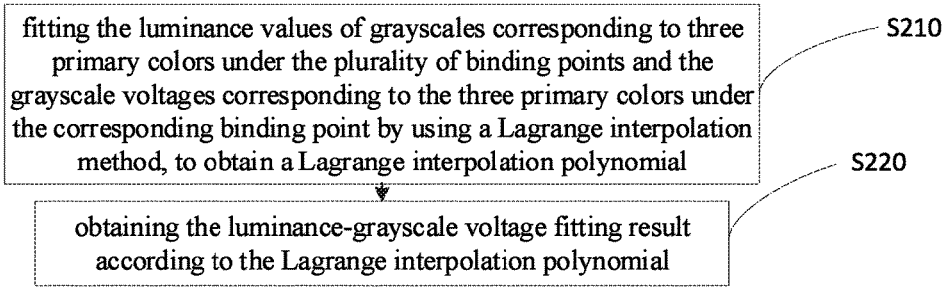
FIG. 2 is a flowchart of fitting grayscale voltages corresponding to the three primary colors of the plurality of binding points and luminance values of grayscales corresponding to three primary colors under the corresponding binding point in the embodiment of the present disclosure.

In the second method, as shown in FIG. 2, the fitting the luminance values of grayscales corresponding to three primary colors under the plurality of binding points and the grayscale voltages corresponding to the three primary colors under the corresponding binding point, to obtain a luminance-grayscale voltage fitting result includes:

S210: fitting the luminance values of grayscales corresponding to three primary colors under the plurality of binding points and the grayscale voltages corresponding to the three primary colors under the corresponding binding point by using a Lagrange interpolation method, to obtain a Lagrange interpolation polynomial;

S220: obtaining the luminance-grayscale voltage fitting result according to the Lagrange interpolation polynomial; the luminance-grayscale voltage fitting result being a relation curve between the luminance values of grayscales corresponding to three primary colors and the corresponding grayscale voltages.

When luminance values of grayscales corresponding to three primary colors under a plurality of the same binding points and the gray voltages corresponding to the three primary colors under the corresponding binding point are fit, the resulting luminance-grayscale voltage fitting result is a relation curve of the luminance values of grayscales corresponding to the three primary colors and the corresponding grayscale voltages under the same binding point.

When luminance values of grayscales corresponding to three primary colors under a plurality of different binding points and the gray voltages corresponding to the three primary colors under the corresponding binding point are fit, the resulting luminance-grayscale voltage fitting result is a relation curve of the luminance values of grayscales corresponding to the three primary colors and the corresponding grayscale voltages under different binding points.

Comparing the above two methods, it can be seen that the second method is a further improvement based on the first method. That is, in the first method, a Lagrange interpolation polynomial is the luminance-grayscale voltage fitting result. The second method is based on the first method, which obtains the luminance-grayscale voltage fitting result being a relation curve between the luminance values of grayscales corresponding to three primary colors and the corresponding grayscale voltages according to the Lagrange interpolation polynomial, where a relation curve between the luminance values of grayscales corresponding to three primary colors under different binding points and the grayscale voltages corresponding to the three primary colors under different binding points is served as the luminance-grayscale voltage fitting result.

Further, for the convenience of operation, after the fitting is performed by the second method, when a grayscale voltage corresponding to the target luminance of each grayscale corresponding to three primary colors in the target image is searched from the luminance-grayscale voltage fitting result based on the target luminance $L_g$ of each grayscale corresponding to three primary colors in a target image subsequently, the data can be directly read from the curve (i.e., the three primary colors in the target image correspond to the grayscale voltage corresponding to the target luminance of each grayscale). However, if the first method is used for fitting, when a grayscale voltage corresponding to the target luminance of each grayscale corresponding to three primary colors in the target image is searched from the luminance-grayscale voltage fitting result based on the target luminance $L_g$ of each grayscale corresponding to three primary colors in a target image subsequently, it is necessary to obtain the data by calculation (i.e., the three primary colors in the target image correspond to the grayscale voltage corresponding to the target luminance of each grayscale). It can be seen that it facilitates the subsequent searching for the grayscale voltage corresponding to the target luminance of each grayscale corresponding to the three primary colors in the target image by using the fitting of the second method, and it is better in operability.

In the above description, the used Lagrange interpolation method is merely illustrative. Mathematically, the luminance-grayscale voltage fitting result referred to in this application may be performed through various interpolation fitting algorithms, such as Newton interpolation, Hermite interpolation, and piecewise polynomial interpolation and so on.

In order to ensure that the display apparatus can display a picture having the target image quality, after the grayscale voltage corresponding to the target luminance of each grayscale corresponding to three primary colors in the target image is written into the second storage unit 002 as shown in FIG. 4 described above, as shown in FIG. 1, the grayscale voltage adjusting apparatus provided by the above embodiment further includes:

step S410: receiving luminance values of grayscales corresponding to three primary colors under at least one binding point in a detection screen displayed by the display apparatus according to the target grayscale voltage, to obtain detection luminance values of grayscales corresponding to three primary colors under at least one binding point;

step S420: judging whether all the detection luminance values of grayscales corresponding to three primary colors under at least one binding point are equal to target luminances of grayscales corresponding to three primary colors under the corresponding binding point;

if it satisfies, controlling the display apparatus to store the target grayscale voltage, so that the display apparatus displays a picture having the target image quality according to the target grayscale voltage stored by the second storage unit;

otherwise, the fitting conditions being possible to have problems, performing step S430;

step S430: adjusting a fitting condition used when the grayscale voltages corresponding to the three primary colors under the plurality of binding points and the luminance values of grayscales corresponding to three primary colors under the corresponding binding point are fit, and returning to S200. If the Lagrange interpolation method is adopted, the order n is adjusted. Of course, it can also be to adjust other parameters or change the data fitting method.

Figure 3:
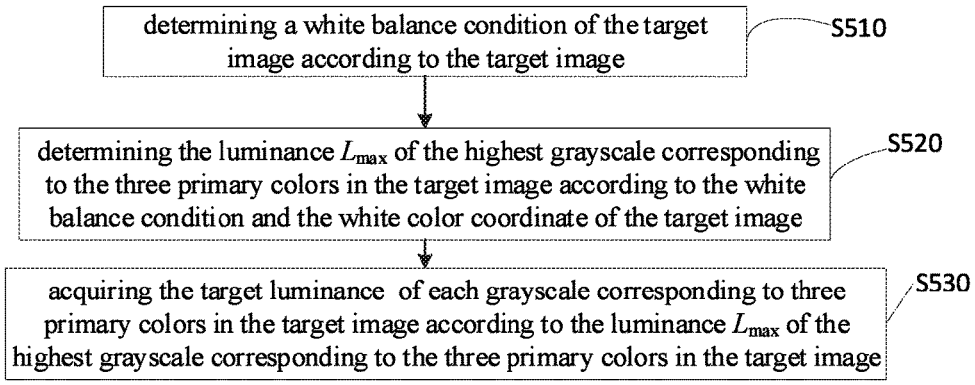
FIG. 3 is a flowchart of acquiring a target luminance of each grayscale corresponding to three primary colors in a target image in the embodiment of the present disclosure.

Further, before searching a grayscale voltage corresponding to the target luminance of each grayscale corresponding to three primary colors in the target image from the luminance-grayscale voltage fitting result, as shown in FIG. 3, the target luminance $L_g$ of each grayscale corresponding to three primary colors in a target image may be obtained as follows steps.

Step S510: a white balance condition of the target image is determined according to the target image. The white balance condition of the target image is calculated according to the requirements of the XYZ colorimetric system, which is the prior art and will not be described again herein. The white balance condition of the target image is:

$$L_R = \frac{y_R[(y-y_G)(x_B-x)+(x-x_G)(y-y_B)]}{y_B[(y-y_G)(x-x_R)+(x-x_G)(y_R-y)]} \cdot L_B$$

$$L_G = \frac{y_G(y-y_R)[(y-y_G)(x_B-x)+(x-x_G)(y-y_B)] - y_G(y_B-y)[(y-y_B)(x-x_R)+(x-x_G)(y_R-y)]}{y_B[(y-y_G)(x-x_R)+(x-x_G)(y_R-y)](y-y_G)} \cdot L_B$$

wherein, $L_R$ is a luminance of a grayscale corresponding to red, $L_G$ is a luminance of a grayscale corresponding to green, $L_B$ is a luminance of a grayscale corresponding to blue, x and y are white color coordinates, $x_R$, $y_R$ are red color coordinates, $x_G$, $y_G$ are green color coordinates and $x_B$, $y_B$ are blue color coordinate.

Step S520: a luminance $L_{max}$ of a highest grayscale corresponding to the three primary colors in the target image is determined according to the white balance condition and a white color coordinate of the target image. It can be understood that the white color is formed by mixing three colors of red, green, and blue in equal proportions. In this case, the luminance of the grayscale corresponding to the three primary colors is the luminance $L_{max}$ of a highest grayscale corresponding to the three primary colors.

For example, after the maximum target luminance of white is set, according to $L_R+L_G+L_B=L_W$, and the above white balance condition, the luminance $L_{max}$ of a highest grayscale corresponding to the three primary colors in the target image may be determined, which specifically includes a luminance $L_{Rmax}$ of a highest grayscale corresponding to the red color in the target image, a luminance $L_{Gmax}$ of a highest grayscale corresponding to the green color in the target image, and a luminance $L_{Bmax}$ of a highest grayscale corresponding to the blue color in the target image.

In step S530: the target luminance $L_g$ of each grayscale corresponding to three primary colors in the target image is acquired according to the luminance $L_{max}$ of the highest grayscale corresponding to the three primary colors in the target image;

$$L_g = \left(\frac{G}{255}\right)^{2.2} \cdot L_{max}$$

wherein G is each grayscale value corresponding to the three primary colors in the target image.

As shown in FIG. 1 and FIG. 4, an embodiment of the present disclosure further provides a grayscale voltage adjusting apparatus, including:

a data receiving unit 100, configured to receive luminance values of grayscales corresponding to three primary colors under at least one binding point, and receive grayscale voltages corresponding to the three primary colors under the corresponding binding point;

a data fitting unit 200, connected to the data receiving unit 100 and configured to fit the luminance values of grayscales corresponding to three primary colors under the plurality of binding points and the grayscale voltages corresponding to the three primary colors under the corresponding binding point, to obtain a luminance-grayscale voltage fitting result;

a data query unit 300, connected to the data fitting unit 200 and configured to, based on the luminance-grayscale voltage fitting result, according to a target luminance $L_g$ of each grayscale corresponding to three primary colors in a target image, search a target grayscale voltage corresponding to the target luminance of each grayscale corresponding to three primary colors in the target image from the luminance-grayscale voltage fitting result, such that a display apparatus displays the target image according to the target grayscale voltage.

It should be understood that the unit modules such as the data receiving unit 100, the data fitting unit 200 and the data query unit 300 according to the present disclosure may be configured using a corresponding hardware entity. For example, the data receiving unit 100 may be a corresponding data receiving circuit. Alternatively, the unit modules such as the data receiving unit 100, the data fitting unit 200 and the data query unit 300 according to the present disclosure may be configured using a corresponding software algorithm. For example, the data receiving unit may be computer instructions stored in a computer readable medium that, when executed by a processor, cause the processor to perform a corresponding data receiving operation. Other similar units according to the present disclosure may be configured in a similar manner, which will not be repeated herein.

The specific implementation process of the grayscale voltage adjusting apparatus provided in the embodiment of the present disclosure will be described in detail below with reference to the accompanying drawings.

Step S100: the data receiving unit 100 receives luminance values of grayscales corresponding to three primary colors under at least one binding point, and receives grayscale voltages corresponding to the three primary colors under the corresponding binding point.

In the embodiment, the luminance values of grayscales corresponding to three primary colors under at least one binding point are measured by the measurement unit 001 and communicated with the data receiving unit 100, so that the measurement unit 001 sends the luminance values of grayscales corresponding to three primary colors under a plurality of binding points to the data receiving unit 100. The grayscale voltages corresponding to the three primary colors under the at least one binding point can communicate with the data receiving unit 100 through the storage unit 002 (such as a register), so that the grayscale voltage can be taken out from the storage unit 002 and sent to the data receiving unit 100. Of course, the grayscale voltages corresponding to the three primary colors under at least one binding point may also be written into the data receiving unit 100 jointly when the grayscale voltage is written into the storage unit 002, so that the data receiving unit 100 receives the grayscale voltages corresponding to the three primary colors under the plurality of binding points, and the data receiving unit 100 may communicate with the data writing unit 400.

Step S200: the data fitting unit 200 fits the luminance values of grayscales corresponding to three primary colors under the plurality of binding points and the grayscale voltages corresponding to the three primary colors under the corresponding binding point, to obtain a luminance-grayscale voltage fitting result.

Step S300: the data query unit 300, according to a target luminance $L_g$ of each grayscale corresponding to three primary colors in a target image, searches a target grayscale voltage corresponding to the target luminance of each grayscale corresponding to three primary colors in the target image from the luminance-grayscale voltage fitting result, such that a display apparatus displays the target image according to the target grayscale voltage.

Compared with the prior art, the beneficial effect of the grayscale voltage adjusting apparatus provided by the embodiment of the present disclosure is the same as that of the grayscale voltage adjusting method provided in the foregoing embodiment, and details are not described herein again.

It can be understood that the grayscale voltage adjusting apparatus provided in the above embodiment further includes a data writing unit 400 and a storage unit 002 connected to the data writing unit 400 (as described above, since different storage hardware are external storage hardware for the logic operation processor, for convenience of drawing, they are uniformly labeled as the storage unit 002. In a specific implementation, multiple storage units or the same one storage unit may be used as needed. For example, the storage unit 002 includes a first storage unit and a second storage unit). The storage unit 002 may be a register in the display apparatus, and may also be other storage devices.

At this time, the configuration functions of the data query unit 300, the data writing unit 400, and the storage unit 002 can be performed in the following two implementations.

In the first implementation manner, as shown in FIG. 4, the data fitting unit 200 is connected to the data writing unit 400, the data writing unit 400 is connected to the storage unit 002, and the data query unit 300 is connected with the storage unit 002 and the data writing unit 400 respectively. In this way, before the data query unit 300 searches the target grayscale voltage corresponding to the target luminance of each grayscale corresponding to three primary colors in the target image, the data writing unit may be configured to write the luminance-grayscale voltage fitting result into the first storage unit of the storage unit 002. The data query unit 300 searches a target grayscale voltage corresponding to the target luminance of each grayscale corresponding to three primary colors in the target image from the luminance-grayscale voltage fitting result written into the first storage unit of the storage unit 002. Meanwhile, after the data query unit 300 finds the target grayscale voltage, the data query unit 300 is further configured through the data writing unit 400 to write the found target grayscale voltage corresponding to the target luminance of each grayscale corresponding to three primary colors in the target image into the second storage unit of the storage unit 002.

In the second implementation manner, as shown in FIG. 4, the data query unit 300 communicates with the second storage unit in the storage unit 002 through the data writing unit 400. After the data query unit 300 searches a target grayscale voltage corresponding to the target luminance of each grayscale corresponding to three primary colors in the target image from the luminance-grayscale voltage fitting result according to the target luminance $L_g$ of each grayscale corresponding to three primary colors in the target image, the data writing unit 400 is configured to write the target grayscale voltage corresponding to the target luminance of each grayscale corresponding to three primary colors in the target image into the second storage unit of the storage unit 002. That is, after the data query unit 300 searches a target grayscale voltage corresponding to the target luminance of each grayscale corresponding to three primary colors in the target image from the luminance-grayscale voltage fitting result according to the target luminance $L_g$ of each grayscale corresponding to three primary colors in the target image, the data query unit 300 writes the target grayscale voltage to the second storage unit in the storage unit 002 through the data writing unit 400. In this way, the display apparatus may display the picture with target image quality according to the target grayscale voltage stored in the second storage unit of the storage unit 002. In this method, it can be considered that there is no first storage unit in the storage unit. It is just for consistency with the word description of the first implementation, the description of the second storage unit in the storage unit 002 is used herein.

When the data fitting unit 200 achieves its own functions, it can be implemented in the following two specific ways.

In the first manner, as shown in FIG. 2, the data fitting unit 200 is configured to fit the luminance values of grayscales corresponding to three primary colors under the plurality of binding points and the grayscale voltages corresponding to the three primary colors under the corresponding binding point by using the Lagrange interpolation method, to obtain a luminance-grayscale voltage fitting result; the luminance-grayscale voltage fitting result being a Lagrange interpolation polynomial.

In the second method, as shown in FIG. 2, the data fitting unit 200 is configured to fit the luminance values of grayscales corresponding to three primary colors under the plurality of binding points and the grayscale voltages corresponding to the three primary colors under the corresponding binding point by using the Lagrange interpolation method, to obtain a Lagrange interpolation polynomial; obtain a luminance-grayscale voltage fitting result according to the Lagrange interpolation polynomial; the luminance-grayscale voltage fitting result being a relation curve between the luminance values of grayscales corresponding to three primary colors and the corresponding grayscale voltages.

When the function of the data query unit 300 is implemented, it is required to search a grayscale voltage corresponding to the target luminance of each grayscale corresponding to three primary colors in the target image from the luminance-grayscale voltage fitting result based on the target luminance $L_g$ of each grayscale corresponding to three primary colors in the target image. In the embodiment, in order to set the target luminance $L_g$ of each grayscale corresponding to three primary colors in the target image as needed, as shown in FIG. 4, the grayscale voltage adjusting apparatus provided in the above embodiment further includes: a target setting unit 500, connected to the data receiving unit 100, the data receiving unit 100 being further configured to receive the desired target image. The target setting unit 500 is configured to obtain the target luminance $L_g$ of each grayscale corresponding to the three primary colors in the target image according to the target luminance.

Specifically, the target setting unit 500 includes a white balance condition setting unit 501 connected with the data receiving unit 100 and is configured to acquire a target image quality according to the target image, and determine a white balance condition of the target image according to the target image quality; the white balance condition of the target image is:

$$L_R = \frac{y_R[(y-y_G)(x_B-x)+(x-x_G)(y-y_B)]}{y_B[(y-y_G)(x-x_R)+(x-x_G)(y_R-y)]}\cdot L_B$$

$$L_G = \frac{y_G(y-y_R)[(y-y_G)(x_B-x)+(x-x_G)(y-y_B)] - y_G(y_B-y)[(y-y_G)(x-x_R)+(x-x_G)(y_R-y)]}{y_B[(y-y_G)(x-x_R)+(x-x_G)(y_R-y)](y-y_G)}\cdot L_B$$

wherein, $L_R$ is a luminance of a grayscale corresponding to red, $L_G$ is a luminance of a grayscale corresponding to green, $L_B$ is a luminance of a grayscale corresponding to blue, x and y are white color coordinates, $x_R$, $y_R$ are red color coordinates, $x_G$, $y_G$ are green color coordinates, and $x_B$, $y_B$ are blue color coordinate.

A maximum luminance determining unit 502 is connected to the white balance condition setting unit 501 and configured to determine a luminance $L_{max}$ of a highest grayscale corresponding to the three primary colors in the target image according to the white balance condition and a white color coordinate of the target image.

A target luminance determining unit 503 is connected to the maximum luminance determining unit 502 and the data query unit 300, and configured to acquire the target luminance $L_g$ of each grayscale corresponding to the three primary colors in the target image according to the luminance $L_{max}$ of the highest grayscale corresponding to the three primary colors in the target image;

$$L_g = \left(\frac{G}{255}\right)^{2.2} \cdot L_{max}$$

wherein G is each grayscale value corresponding to the three primary colors in the target image.

Figure 5:
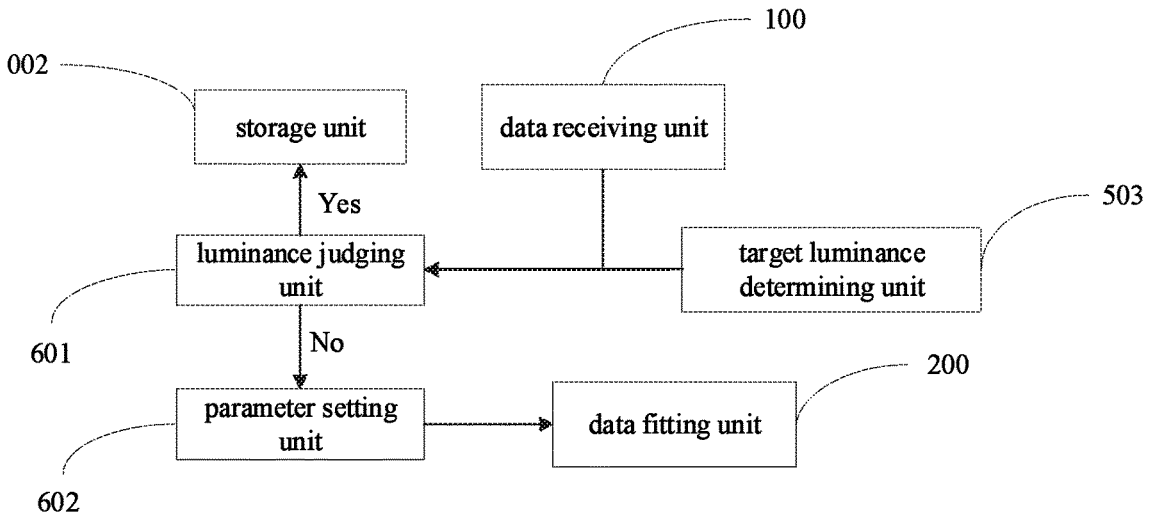
FIG. 5 is a structural block diagram of a luminance judging unit and a parameter setting unit in an embodiment of the present disclosure.

In order to ensure that the grayscale voltage adjusted by the grayscale voltage adjusting apparatus can make the picture displayed by the display apparatus have target image quality, as shown in FIGS. 1 and 5, the above grayscale voltage adjusting apparatus further includes a luminance judging unit 601 and a parameter setting unit 602. The luminance judging unit 601 is connected to the target luminance determining unit 503, the data receiving unit 100, the storage unit 002, and the parameter setting unit 602 respectively, and the parameter setting unit 602 is connected to the data fitting unit 200.

The data receiving unit 100 is further configured to receive luminance values of grayscales corresponding to three primary colors under at least one binding point in a detection screen displayed by the display apparatus according to the target grayscale voltage stored in the storage unit 002 (for example, the second storage unit therein), to obtain detection luminance values of grayscales corresponding to three primary colors under at least one binding point.

The luminance judging unit 601 is configured to judge whether all the detection luminance values of grayscales corresponding to three primary colors under at least one binding point are equal to target luminances of grayscales corresponding to three primary colors under the corresponding binding point.

The storage unit 002 is configured to store the target grayscale voltage when all the detection luminance values of grayscales corresponding to three primary colors under at least one binding point are equal to target luminances of grayscales corresponding to three primary colors under the corresponding binding point.

The parameter setting unit 602 is configured to, when not all the detection luminance values of grayscales corresponding to three primary colors under at least one binding point are equal to target luminances of grayscales corresponding to three primary colors under the corresponding binding point, adjust a fitting condition used when the grayscale voltages corresponding to the three primary colors under the at least one binding point and the luminance values of grayscales corresponding to three primary colors under the corresponding binding point are fit.

A further method for supplementing the grayscale voltage adjusting apparatus provided in the embodiment of the present disclosure will be described below in combination with FIG. 1.

Step S410: the data receiving unit 100 receives luminance values of grayscales corresponding to three primary colors under at least one binding point in a detection screen displayed by the display apparatus according to the target grayscale voltage stored in the storage unit 002 (for example, the second storage unit therein), to obtain detection luminance values of grayscales corresponding to three primary colors under at least one binding point.

Step S420: the luminance judging unit 601 judges whether all the detection luminance values of grayscales corresponding to three primary colors under at least one binding point are equal to target luminances of grayscales corresponding to three primary colors under the corresponding binding point.

If it satisfies, the storage unit 002 is controlled to store the grayscale voltage, so that the display apparatus displays a picture having the target image quality according to the grayscale voltage corresponding to the target luminance of each grayscale in the target image stored by the second storage unit 002.

Otherwise, the step S430 is performed.

Step S430: the parameter setting unit 602 adjusts a fitting condition used when the grayscale voltages corresponding to the three primary colors under the plurality of binding points and the luminance values of grayscales corresponding to three primary colors under the corresponding binding point are fit, and it is returned to S200.

Figure 6:
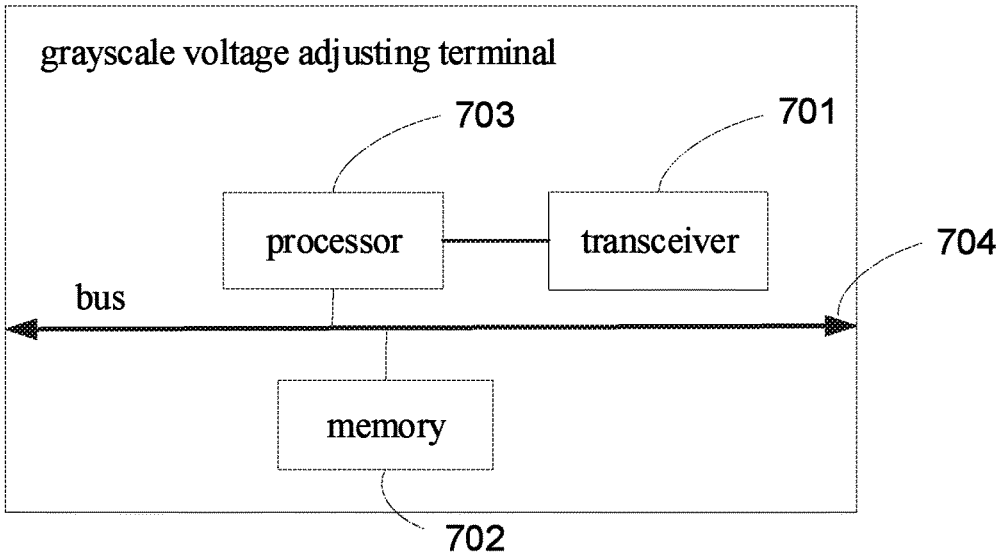
FIG. 6 is a hardware structural diagram of a grayscale voltage adjusting terminal according to an embodiment of the present disclosure.

As shown in FIG. 6, an embodiment of the present disclosure further provides a grayscale voltage adjusting terminal 700. The grayscale voltage adjusting terminal includes a transceiver 701, a memory 702, and a processor 703. The transceiver 701, memory 702, and processor 703 communication with each other via a bus 704.

The transceiver 701 is configured to support the processor 703 to communicate with the measurement unit 001 and the storage unit 002 as shown in FIG. 4, so that the processor 703 collects various luminance data and grayscale voltage data. Of course, the grayscale voltage data may also be acquired from the data writing device, and the transceiver 701 communicates with the data writing device at this time. In addition, the transceiver 701 can also support the processor to send various information to the measurement unit 001 and the storage unit 002. For example, when it needs to confirm whether the updated grayscale voltage is accurate, a measurement instruction may be sent to the measurement unit 001. When it is necessary to confirm to store the storage unit 002, a storage instruction may be sent to the storage unit 002.

The memory 702 is configured to store an application designed by executing the grayscale voltage adjusting method and a logical operation result of the application program. The memory 702 may be physical implementation of the above storage unit 002.

The processor 703 is configured to perform logic operations, including loading the application program from the memory and executing a corresponding logic operation instruction, to implement the grayscale voltage adjusting method.

In the embodiment, the processor 703 described in this embodiment of the present disclosure may be a processor, or may be a collective name of a plurality of processing elements. For example, the processor 703 may be a Central Processing Unit (CPU), or may also be an Application Specific Integrated Circuit (ASIC), or may be one or more integrated circuit configured to implement embodiments of the present disclosure, for example: one or more digital signal processors (DSP), or one or more Field Programmable Gate Arrays (FPGAs).

The memory 702 may be a storage apparatus, may also be a collective name of a plurality of storage elements, storage units, and is used to store executable program codes and the like. The memory 702 may include a random access memory (RAM), and may also include a non-volatile memory such as a disk memory, a Flash, and the like.

The bus 704 may be an Industry Standard Architecture (ISA) bus, a Peripheral Component (PCI) bus, an Extended Industry Standard Architecture (EISA) bus, or the like. The bus 704 can be divided into an address bus, a data bus, a control bus, and the like. For ease of illustration, only one bold line is used in FIG. 6, but it does not mean that there is only one bus or a bus of one type.

An embodiment of the present disclosure further provides a display driving apparatus, including the grayscale voltage adjusting apparatus or the grayscale voltage adjusting terminal provided in the above embodiment.

Compared with the prior art, the beneficial effect of the grayscale voltage adjusting apparatus provided by the embodiment of the present disclosure is the same as that of the grayscale voltage adjusting method provided in the above technical solution, and details are not described herein again.

An embodiment of the present disclosure further provides a display apparatus including the display driving apparatus or the grayscale voltage adjusting apparatus provided in the above embodiments.

Compared with the prior art, the beneficial effects of the display apparatus provided by the embodiments of the present disclosure are the same as those of the grayscale voltage adjusting method provided by the above technical solution, and are not described herein.

The display apparatus provided by the above embodiments may be any product or component that has a display function such as a mobile phone, a tablet computer, a television set, a display, a notebook computer, a digital photo frame, or a navigator.

Each embodiment in this specification is described in a progressive manner. The same or similar parts among the embodiments can be referred to each other. Each embodiment focuses on the difference from other embodiments. In particular, for the apparatus embodiment, because it is basically similar to the method embodiment, the description is relatively simple, and for the related parts, reference may be made to the partial description of the method embodiment.

Persons of ordinary skill in the art can understand that all or part of the processes in implementing the method of the above embodiments can be accomplished by a computer program instructing related hardware, and the program can be stored in a computer-readable storage medium. When executed, the program may include the flow of an embodiment of each method as described above. The storage medium may be a magnetic disk, an optical disk, a Read-Only Memory (ROM) or a Random Access Memory (RAM) or the like.

What is claimed is:

1. A grayscale voltage adjusting apparatus, comprising: a data receiving unit, configured to receive luminance values of grayscales corresponding to three primary colors under at least one binding point, and receive grayscale voltages corresponding to the three primary colors under the corresponding binding point; a data fitting unit, connected to the data receiving unit and configured to fit the luminance values of grayscales corresponding to three primary colors under the plurality of binding points and the grayscale voltages corresponding to the three primary colors under the corresponding binding point, to obtain a luminance-grayscale voltage fitting result; a data query unit, connected to the data fitting unit and configured to, based on the luminance-grayscale voltage fitting result, according to a target luminance L.sub.g of each grayscale corresponding to three primary colors in a target image, search a target grayscale voltage corresponding to the target luminance of each grayscale corresponding to three primary colors in the target image from the luminance-grayscale voltage fitting result, such that a display apparatus displays the target image according to the target grayscale voltage, wherein the grayscale voltage adjusting apparatus further comprising: a data writing unit connected to the data fitting unit, the data writing unit being connected to a first storage unit and a second storage unit, and the data query unit being connected to the first storage unit and the data writing unit respectively; wherein the data writing unit is configured to write the luminance-grayscale voltage fitting result into the first storage unit; and write the target grayscale voltage corresponding to the target luminance of each grayscale corresponding to three primary colors in the target image into the second storage unit.

2. The grayscale voltage adjusting apparatus according to claim 1, further comprising a data writing unit connected to the data query unit, the data writing unit being connected to the second storage unit;

wherein the data writing unit is configured to write the target grayscale voltage corresponding to the target luminance of each grayscale corresponding to three primary colors in the target image into the second storage unit.

3. The grayscale voltage adjusting apparatus according to claim 1, wherein the data fitting unit is configured to obtain the luminance-grayscale voltage fitting result by using a Lagrangian interpolation method; and the luminance-grayscale voltage fitting result is a Lagrange interpolation polynomial.

4. The grayscale voltage adjusting apparatus according to claim 1, wherein the luminance-grayscale voltage fitting result of the data fitting unit represents a relation curve between the luminance values of grayscales corresponding to three primary colors and the corresponding grayscale voltages.

5. The grayscale voltage adjusting apparatus according to claim 1, wherein the data receiving unit is further configured to receive the target image;

the grayscale voltage adjusting apparatus further comprises:

a white balance condition setting unit, connected to the data receiving unit and configured to determine a white balance condition of the target image according to the target image;

a maximum luminance determining unit, connected to the white balance condition setting unit and configured to determine a luminance $L_{max}$ of a highest grayscale corresponding to the three primary colors in the target image according to the white balance condition and a white color coordinate of the target image;

a target luminance determining unit, connected to the maximum luminance determining unit and configured to acquire the target luminance $L_g$ of each grayscale corresponding to the three primary colors in the target image according to the luminance $L_{max}$ of the highest grayscale corresponding to the three primary colors in the target image.

6. The grayscale voltage adjusting apparatus according to claim 5, wherein the white balance condition of the target image is:

$$L_R = \frac{y_R[(y-y_G)(x_B-x)+(x-x_G)(y-y_B)]}{y_B[(y-y_G)(x-x_R)+(x-x_G)(y_R-y)]} \cdot L_B$$

$$L_G = \frac{y_G(y-y_R)[(y-y_G)(x_B-x)+(x-x_G)(y-y_B)] - y_G(y_B-y)[(y-y_G)(x-x_R)+(x-x_G)(y_R-y)]}{y_B[(y-y_G)(x-x_R)+(x-x_G)(y_R-y)](y-y_G)} \cdot L_B$$

wherein, $L_R$ is a luminance of a grayscale corresponding to red, $L_G$ is a luminance of a grayscale corresponding to green, $L_B$ is a luminance of a grayscale corresponding to blue, x and y are white color coordinates, $x_R$, $y_R$ are red color coordinates, $x_G$, $y_G$ are green color coordinates, and $x_B$, $y_B$ are blue color coordinate;

the target luminance $L_g$ of each grayscale in the target image is:

$$L_g = \left(\frac{G}{255}\right)^{2.2} \cdot L_{max}$$

wherein G is each grayscale value corresponding to the three primary colors in the target image.

7. The grayscale voltage adjusting apparatus according to claim 5, wherein the grayscale voltage adjusting apparatus further comprises: a luminance judging unit and a parameter setting unit; the luminance judging unit is connected to the target luminance determining unit, the data receiving unit, the storage unit, and the parameter setting unit respectively, and the parameter setting unit is connected to the data fitting unit;

the data receiving unit is further configured to receive luminance values of grayscales corresponding to three primary colors under at least one binding point in a detection screen displayed by the display apparatus according to the target grayscale voltage, to obtain detection luminance values of grayscales corresponding to three primary colors under at least one binding point;

the luminance judging unit is configured to judge whether all the detection luminance values of grayscales corresponding to three primary colors under at least one binding point are equal to target luminances of grayscales corresponding to three primary colors under the corresponding binding point;

the storage unit is configured to store the target grayscale voltage when all the detection luminance values of grayscales corresponding to three primary colors under at least one binding point are equal to target luminances of grayscales corresponding to three primary colors under the corresponding binding point;

the parameter setting unit is configured to, when not all the detection luminance values of grayscales corresponding to three primary colors under at least one binding point are equal to target luminances of grayscales corresponding to three primary colors under the corresponding binding point, adjust a fitting condition used when the grayscale voltages corresponding to the three primary colors under the at least one binding point and the luminance values of grayscales corresponding to three primary colors under the corresponding binding point are fit.

8. A display driving apparatus, comprising the grayscale voltage adjusting apparatus according to claim 1.

9. A display apparatus, comprising the display driving apparatus according to claim 8.

10. A grayscale voltage adjusting method, comprising: step S100: receiving luminance values of grayscales corresponding to three primary colors under at least one binding point, and receiving grayscale voltages corresponding to the three primary colors under the corresponding binding point; step S200: fitting the luminance values of grayscales corresponding to three primary colors under the plurality of binding points and the grayscale voltages corresponding to the three primary colors under the corresponding binding point, to obtain a luminance-grayscale voltage fitting result; step S300: based on the luminance-grayscale voltage fitting result, according to a target luminance L.sub.g of each grayscale corresponding to three primary colors in a target image, acquiring a target grayscale voltage corresponding to the target luminance of each grayscale corresponding to three primary colors in the target image from the luminance-grayscale voltage fitting result, such that a display apparatus displays the target image according to the target grayscale voltage, wherein the step S300 comprises: writing the luminance-grayscale voltage fitting result into a first storage unit of the display apparatus, querying the target grayscale voltage corresponding to the target luminance of each grayscale corresponding to three primary colors in the target image from the luminance-grayscale voltage fitting result stored in the first storage unit according to the target luminance L.sub.g of each grayscale corresponding to three primary colors in the target image, and storing the same in a second storage unit of the display apparatus, such that the display apparatus displays the target image according to the target grayscale voltage stored in the second storage unit.

11. The grayscale voltage adjusting method according to claim 10, wherein the step S300 comprises:

based on the target luminance $L_g$ of each grayscale corresponding to three primary colors in the target image, searching a grayscale voltage corresponding to the target luminance of each grayscale corresponding to three primary colors in the target image from the luminance-grayscale voltage fitting result; writing the grayscale voltage corresponding to the target luminance of each grayscale corresponding to three primary colors in the target image into a second storage unit of the display apparatus, such that the display apparatus displays the target image according to the target grayscale voltage stored in the second storage unit.

12. The grayscale voltage adjusting method according to claim 10, wherein the fitting the grayscale voltages corresponding to the three primary colors under the plurality of binding points and the luminance values of grayscales corresponding to three primary colors under the corresponding binding point, to obtain a luminance-grayscale voltage fitting result comprises:

fitting the grayscale voltages corresponding to the three primary colors of the plurality of binding points and the luminance values of grayscales corresponding to three primary colors under the corresponding binding point by using a Lagrange interpolation method, to obtain the luminance-grayscale voltage fitting result; the luminance-grayscale voltage fitting result being a Lagrange interpolation polynomial or a relation curve between the luminance values of grayscales corresponding to three primary colors and the corresponding grayscale voltages.

13. The grayscale voltage adjusting method according to claim 10, wherein the target luminance of each grayscale in the target image is obtained as follows:

determining a white balance condition of the target image according to the target image; determining a luminance $L_{max}$ of a highest grayscale corresponding to the three primary colors in the target image according to the white balance condition and a white color coordinate of the target image; and acquiring the target luminance $L_g$ of each grayscale corresponding to the three primary colors in the target image according to the luminance $L_{max}$ of the highest grayscale corresponding to the three primary colors in the target image.

14. The grayscale voltage adjusting method according to claim 13, wherein the white balance condition of the target image is:

$$L_R = \frac{y_R[(y-y_G)(x_B-x)+(x-x_G)(y-y_B)]}{y_B[(y-y_G)(x-x_R)+(x-x_G)(y_R-y)]} \cdot L_B$$

$$L_G = \frac{y_G(y-y_R)[(y-y_G)(x_B-x)+(x-x_G)(y-y_B)] - y_G(y_B-y)[(y-y_G)(x-x_R)+(x-x_G)(y_R-y)]}{y_B[(y-y_G)(x-x_R)+(x-x_G)(y_R-y)](y-y_G)} \cdot L_B$$

determining the luminance $L_{max}$ of the highest grayscale corresponding to the three primary colors in the target image according to the white balance condition and the white color coordinate of the target image;

acquiring the target luminance $L_g$ of each grayscale corresponding to three primary colors in the target image according to the luminance $L_{max}$ of the highest grayscale corresponding to the three primary colors in the target image;

$$L_g = \left(\frac{G}{255}\right)^{2.2} \cdot L_{max}$$

wherein, $L_R$ is a luminance of a grayscale corresponding to red, $L_G$ is a luminance of a grayscale corresponding to green, $L_B$ is a luminance of a grayscale corresponding to blue, x and y are white color coordinates, $x_R$, $y_R$ are red color coordinates, $x_G$, $y_G$ are green color coordinates, $x_B$, $y_B$ are blue color coordinate; and G is each grayscale value corresponding to the three primary colors in the target image.

15. The grayscale voltage adjusting method according to claim 10, further comprising a step of checking the luminance-grayscale voltage fitting result:

step S410: receiving luminance values of grayscales corresponding to three primary colors under at least one binding point in a detection screen displayed by the display apparatus according to the target grayscale voltage, to obtain detection luminance values of grayscales corresponding to three primary colors under at least one binding point;

step S420: judging whether all the detection luminance values of grayscales corresponding to three primary colors under at least one binding point are equal to target luminances of grayscales corresponding to three primary colors under the corresponding binding point;

if it satisfies, controlling the display apparatus to store the target grayscale voltage;

otherwise, performing step S430;

step S430: adjusting a fitting condition used when the grayscale voltages corresponding to the three primary colors under the plurality of binding points and the luminance values of grayscales corresponding to three primary colors under the corresponding binding point are fit, and returning to step S200.

16. A grayscale voltage adjusting apparatus comprising:

a processor; and a memory stored with instructions that, when being executed, causes the processor to perform the method according to claim 10.

17. A computer-readable storage medium stored with instructions for performing the method according to claim 10.

* * * * *